United States Patent [19]

Frear

[11] Patent Number: 4,645,282

[45] Date of Patent: Feb. 24, 1987

[54] RELEASING ELECTRICAL CONNECTOR ASSEMBLY

[75] Inventor: David L. Frear, Bainbridge, N.Y.

[73] Assignee: Allied Corporation, Morristown, N.J.

[21] Appl. No.: 835,019

[22] Filed: Feb. 28, 1986

[51] Int. Cl.[4] ..... H01R 13/633

[52] U.S. Cl. ..... 339/45 M; 339/92 M

[58] Field of Search ..... 339/92 R, 92 M, 45 R, 339/45 M; 285/316, 34, 35; 411/433, 434

[56] References Cited

U.S. PATENT DOCUMENTS

| | | | |
|---|---|---|---|
| 2,259,137 | 10/1941 | Iftiger, Sr. | 285/35 |
| 2,350,685 | 6/1944 | Kasdan | 411/433 |
| 2,746,022 | 5/1956 | Gilbert | 339/92 M |
| 3,328,743 | 6/1967 | Acord | 339/45 |
| 3,334,536 | 8/1967 | Armstrong | 285/34 |
| 3,430,184 | 2/1969 | Acord | 339/45 |
| 3,452,316 | 6/1969 | Panek et al. | 339/45 |
| 3,458,850 | 7/1969 | Calisher | 339/45 |
| 3,509,515 | 4/1970 | Acord | 339/45 |
| 3,609,632 | 9/1971 | Vetter | 339/14 |
| 4,279,458 | 7/1981 | Knapp | 339/45 M |
| 4,483,575 | 11/1984 | Kruger et al. | 339/92 M |

OTHER PUBLICATIONS

Ser. No. 281,150, (Schildkraut et al), Releasing Electrical Connector, pending.

Ser. No. 453,088, (Ratchford et al), A Moisture Seal for an Electrical Connector, abandoned.

*Primary Examiner*—John McQuade

*Attorney, Agent, or Firm*—C. D. Lacina

[57] ABSTRACT

A manually operable releasable retention arrangement in one connector housing includes a receptacle comprised of a pair of split semi-cylindrical segments each pivotally mounted to a drive shaft and adapted to threadably engage a threaded member on a second connector housing. Rotation of the drive shaft causes the segments to interengage with the threaded member whereby to hold the housings together but rearward axial movement of a forwardly biased operating sleeve circumposed about the receptacle brings an annular groove thereon into register with outward annular ribs on the segments allowing the ribs to be received in the groove and the segments to pivot relative to their mounting whereby to release the threaded member.

12 Claims, 4 Drawing Figures

RELEASING ELECTRICAL CONNECTOR ASSEMBLY

This invention relates to mating plug and receptacle connector housing members including an externally actuated lanyard release retention arrangement for releasing the housing members from their mated relation.

Releasing electrical connector designs have included a pair of generally cylindrical plug and receptacle shells and a cylindrical operating sleeve which is mounted about the receptacle shell such that upon application of an external releasing force placed on the operating sleeve by a lanyard attached thereto, the operating sleeve is axially shifted which in turn transmits the releasing forces to a cam arrangement therewithin to produce a release of a retaining connection between the plug and the receptacle. The connection which secures the connector shells also defines the means for transmitting forces to release the connection. Of course manual rotation operates to effect mating and unmating between the connector shells. U.S. Pat. No. 4,279,458 issuing July 21, 1981 to Knapp "Releasing Electrical Connector" is a good example of such a lanyard releasable connector.

In a connector which utilizes such a quick disconnect, the outer diameter of the connector assembly is a direct function of the plug and receptacle shells since the release mechanism must be accommodated around the assembled shells. This increase in assembly size prohibits the use in many applications.

In particular, some applications require use of generally rectangular shaped connector housings. It would be desirable to have a connector assembly other than cylindrical which includes a lanyard releasable connection and which does not unduly increase the overall package size as a result of a quick release arrangement being used therewith.

A lanyard releasable electrical connector assembly includes a pair of laterally elongated, generally rectangular, housing members which are respectively provided with terminal elements which mate with one another when the housing members are mated in a direction transverse to the lateral direction, and a releasable retention arrangement for releasing the connection upon application of an external force.

The releasable retention arrangement includes one or more manually operable jack-screw mechanisms being supported on the housing members, each including a passive male member adapted to be threadably engaged by a segmented receptacle, an operating sleeve mounted in a through passage of one connector member so as to be circumposing the receptacle and adapted to axially slide between retaining and releasing positions, a drive member having rearward end portions of the segments pivotally connected thereto for rotating the receptacle to cause the threads to interengage, and a coil spring which forces the operating sleeve into the retaining position, external force on the operating sleeve such as by a lanyard attached thereto causing the receptacle segments to pivot relative to their connection to the drive member and pivot from engagement with the male member. Axially spaced shoulders from the sleeve and a flange from the drive member cooperate to captivate the coil spring whereby a constant forward spring bias is exerted on the operating sleeve during forward threadable engagement by the receptacle with the male member.

Figure 1:
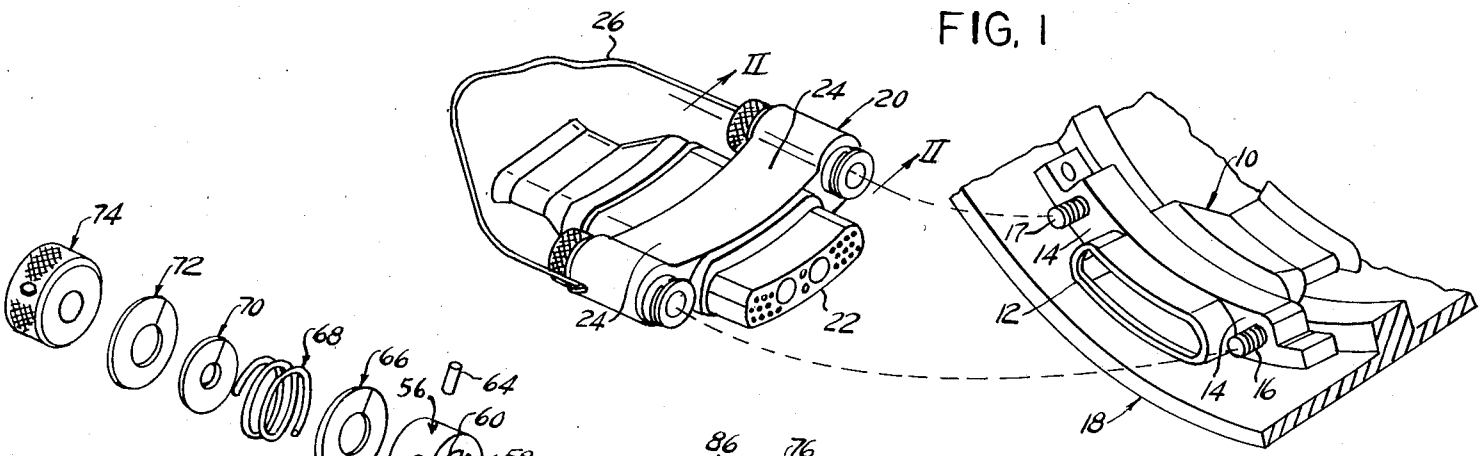
FIG. 1 shows a plug and receptacle housing positioned for mating and a releasing arrangement.

Referring now to the drawings, FIG. 1 shows a first connector housing 10 including a receptacle shell 12 mounted on an arcuate wall adjacent to a mounting bracket and positioned for mating by a second connector housing 20 including a plug shell 22. While not shown the respective connector housing members would each carry terminal elements which mate with one another when the housings are mated. The plug and connector housings are arcuately rectangular so as to fit tight spaces such as might be defined against the internal wall of an airframe panel and each includes a support member 14, 24 at its opposite lateral ends for supporting a lanyard releasable retention device.

The retention arrangement includes a passive threaded male member 16 secured to the support member 14 on the receptacle connector adapted to be actively threadably engaged by a segmented receptacle disposed in the support member 24 on the plug connector. Although shown best in FIGS. 3 and 4, a cylindrical operating sleeve 30 is slidably disposed in a through passage 25 of the plug connector and about the segmented receptacle, the operating sleeve having a lanyard 26 attached thereto to pull the sleeve from a retaining first position to a releasing second position.

Figure 2:
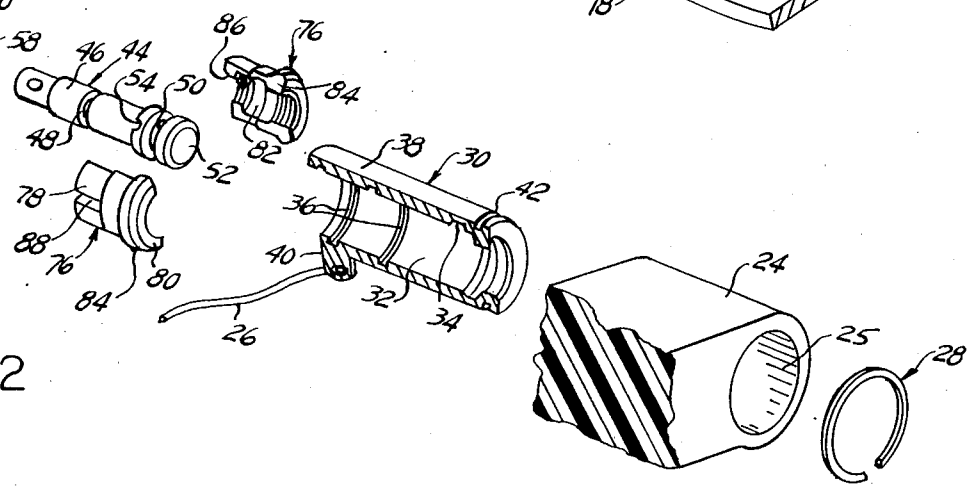
FIG. 2 is an exploded isometric view of the releasing arrangement generally taken along lines II—II of FIG. 1.

FIG. 2 shows an exploded view of the releasing arrangement supported in the plug connector. Proceeding from right to left is shown a retaining ring 28, the support member 24 on the plug connector with the passage 25 therethrough, the operating sleeve 30 sized to fit within the passage, an axially elongated generally cylindrical shaft 44 adapted to fit within the sleeve, a retention collar 56 having a generally cylindrical inner wall which defines an aperture 58 therethrough and adapted to journal the shaft 55 therewithin, a threaded receptacle defined by a pair of semi-cylindrical sleeve segments 76, and a coil spring 68 to bias the operating spring forwardly. While two segments are shown more could be used.

The operating sleeve 30 includes a continous annular groove 34 on its inner wall 32 adjacent to its forward end and a pair of continous axially spaced annular recesses 36. The outer periphery 38 of the operating sleeve includes an ear 40 to which the force receiving lanyard 26 is attached and an annular recess 42 for receiving the retaining ring 28 for retaining the operating sleeve withing the passage.

The shaft 44 includes on its outer periphery 46 an annular recess 48 and an angularly extending socket 50. A forward end face 52 of the shaft is adapted to advance toward the end face 17 on the male member.

Each of the sleeve segments 76 has rearward end 78, a forward end 80, and an inner surface 82 adapted to surround the shaft 44 and provided with thread. The forward end includes on its outer periphery an outwardly extending annular rib 84 and the rearward end includes an inwardly extending annular rib 86, the inward annular ribs 86 defining projections which seat within the socket 50 on the shaft 44 to form pivot connections thereto and the outward annular ribs 84 defining projections which seat within the annular groove 34 in the operating sleeve 30. To transmit external torques "T" from the drive shaft to the segments 76, each segment includes on its outer periphery an axial keyway 88 sized to receive a key 60 extending from the retention collar 56.

An arrangement disposed in the operating sleeve assures that threadable engagement by the segmented receptacle does not diminish the bias on the operating sleeve. A pair of split flat disks 66, 72 are adapted to radially contract and expand to snap fit within within one or the other annular recess 36 disposed on the inner wall 32 of the operating sleeve whereby to provide a pair of axially spaced inwardly extending radial shoulders. A split flat washer 70 is adapted to radially expand contract to snap fit within the annular recess 48 on the axial drive shaft 44 to define an outwardly extending radial flange. The coil spring 68 to bias the operating sleeve 30 into the retaining first position and resist rearward movement into the releasing second position is axially elongated and sized such that its coils encircle the shaft and its forward and rearward end faces are positioned between the disks and abutting the retention collar 56 and washer 70. A knurled knob 74 is attachable to the rearward end portion of the shaft 44 to facilitate rotation of the shaft.

The retention collar 56 is generally cylindrical and includes the aperture 58 extending generally concentrically therethrough to clearance fit about the shaft 44. A pin 64 passes through a radial opening 62 in the collar to be received in a corresponding radial pinhole 54 in the shaft to captivate the collar to the shaft. A pair of arcuate keys 60 adjacent the front face of the collar extend radially inward from the aperture wall, the keys being angularly spaced by an amount substantially the same as the angular separation of the keyways 88 when the segments are mounted to the drive shaft 44 so as to be received in the keyways when the collar is mounted to the shaft. The keys cooperate to abut adjacent angular end faces of the keyways whereby to rotatably drive the segments when the shaft is rotated.

Figure 3:
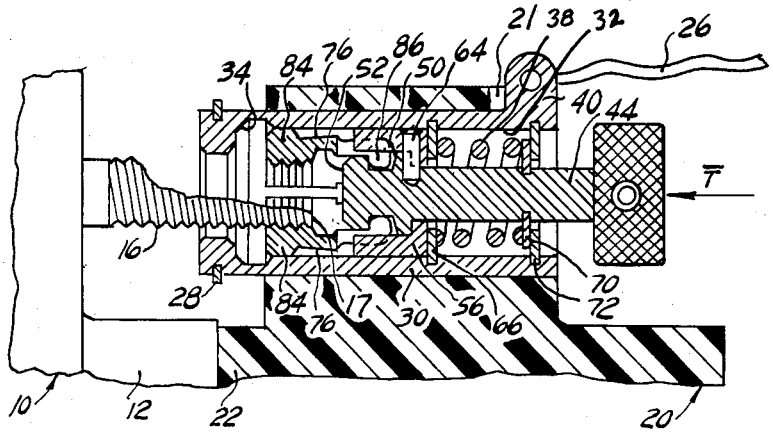
FIG. 3 is a side view in section of the plug being connected to the receptacle.

FIG. 3 shows the connector housings 10, 20 in their mated condition with the segmented receptacle being screwed about the threaded male member 16. The end face 52 of the shaft 44 is axially spaced from the end face 17 of the male member. The inner wall 32 of the operating sleeve 30 abuts the outwardly extending annular ribs 84 of the segments 76 thus constraining the thread portions thereof to engage with the thread on the male member. The ear 40 on the operating sleeve 30 is disposed in an axial slot 21 of the plug connector housing to constrain the operating sleeve to undergo axial movement as the result of an external axial force being placed on the lanyard 26.

The inwardly extending annular ribs 86 and the outwardly extending annular ribs 84, respectively, are generally coplanar and disposed in parallel planes perpendicular to the axis of rotation of the shaft 44. The inwardly extending annular ribs 86 are each seated within the socket 50 on the shaft.

From the start of threadable engagement between the male member and the segmented receptacle, the rearward annular disk 72 abuts the washer 70. The forward annular disk 66 abuts the retention collar 56, and the coil spring 68 has its rearward end face abutting the washer and its forward end face abutting the forward annular disk, rotation of the drive shaft causing the segmented receptacle to axially advance as the segments 76 engage the male member. During this axial advance the washer 70 drives against the rear end face of the coil spring 68 thereby constantly biasing the operating sleeve 30 axially forward as the receptacle segments 76 axially advance. The ear 40 and axial slot 21 will not allow angular movement of the operating sleeve.

Figure 4:
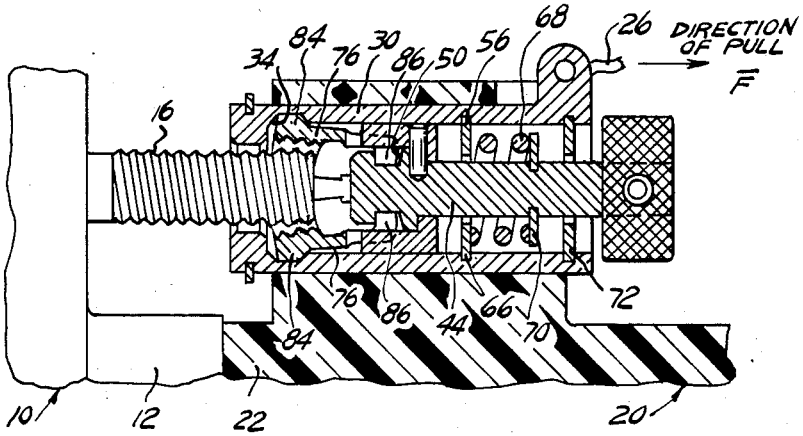
FIG. 4 is a side view in section of the plug being released from the receptacle.

FIG. 4 shows the lanyard 26 having been give a sufficient external force "F" to overcome the forward bias of the coil spring 68 whereby to cause the operating sleeve 30 to be drawn axially rearward. Rearward retreat of the operating sleeve causes the annular groove 34 to move into register with the annular ribs 84 disposed around each of the segments 76 with rearward forces being transmitted to the socket connection thereby causing each segment through its inwardly extending annular ribs 86 to pivot relative to the socket and the thread thereon to disengage with the thread on the male member allowing disengagement of the connectors.

Having thus described the invention what is claimed is:

1. In an electrical connector assembly comprising mateable first and second housing members which are respectively provided with terminal elements which mate with one another when the housing members are mated and releasable retaining means for retaining the housing members in their mated condition, said releasable retaining means characterized by a passive threaded male member secured to one housing member, an active threaded receptacle disposed in a through passage of the other housing member for threadably releasably engaging the male member, an operating sleeve slidably mounted in said passage for axial movement from a retaining first position to a releasing second position, drive means journalled in said sleeve and connected to said receptacle for rotating said receptacle whereby to threadably engage the male member and axially advance the receptacle within the passage, and bias means acting between the sleeve and the receptacle for biasing the operating sleeve forwardly into the first position.

2. The electrical connector assembly as recited in claim 1 wherein said sleeve has an interior annular groove, and said receptacle comprises a pair of semicylindrical segments each being pivotally secured to the drive means, each respective segment having a forward end portion including an annular rib extending radially outward therefrom and a rearward end portion including an annular rib extending radially inward therefrom, the inwardly extending annular ribs being pivotably connected to the drive means whereby upon movement of the operating sleeve rearwardly to the second position the outwardly extending annular ribs register with and seat in the annular groove.

3. The electrical connector assembly as recited in claim 1 wherein said housing members comprise plug and receptacle shell portions which interfit to mate the respective terminal elements, each said shell portion having a support member extending therefrom, the support members being adapted to receive the releasable retaining means with one and the other support member, respectively, receiving the male member and the receptacle.

4. The electrical connector assembly as recited in claim 1 wherein said housing members comprise plug and receptacle shell portions which interfit to mate the respective terminal elements, each said shell portion having a support member extending from opposite sides thereof with respective pairs of support members being adjacent to one another and receiving one said releasable retaining means.

5. In a releasing electrical connector assembly comprising mateable first and second housing members which are respectively provided with terminal elements which mate with one another when the housing members are mated, retaining means for retaining the members together in the mated condition, releasing means including an operating sleeve adapted to move from a retaining first position to a releasing second position for releasing the housing members from their mated condition, and bias means for biasing the operating sleeve into the first position, characterized in that said retaining means comprises one said housing member having an internally threaded segmented receptacle and the other said housing member having an externally threaded male member adapted to insertably threadably engage the receptacle when rotatably screwed thereabout, said releasing means comprises said receptacle and said sleeve including, respectively, an annular rib and an annular groove each being interfittable within one another, and said operating sleeve being slidably captivated within a through passage in the one said housing member for axial movement therewithin, external forces placed on the sleeve registering said rib with said groove and on the thread surfaces camming the segmented receptacle radially whereby the receptacle disengages from the male member, and manually operable drive means including an axial shaft journalled in said operating sleeve and connected to said receptacle for rotatable reciprocating driving movement of said receptacle.

6. The connector assembly as recited in claim 5, characterized by said axial shaft having a pair of sockets, and said receptacle comprising a pair of internally threaded semi-cylindrical sleeve segments, each said sleeve segment being encircled by the operating sleeve and each having a rearward, inwardly extending, annular rib for pivotably mounting the segment in one of said sockets and a forward, outwardly extending, annular rib adapted to pivot radially outward and into the annular groove as a result of the operating sleeve being moved to the second position, the forward and rearward annular ribs, respectively, being coplanar and in planes parallel to one another and perpendicular to the shaft axis of rotation.

7. The connector assembly as recited in claim 4 further characterized by said drive means comprising a manually operable drive shaft encompassed by the interior wall of the sleeve, and said bias means further comprises maintaining means for maintaining a preload bias on the operating sleeve as the shaft rotates and axially threadably advances the receptacle about the male member.

8. The connector assembly as recited in claim 7 wherein said maintaining means comprises a pair of shoulders each extending radially inward from the interior wall of said operating sleeve and a flange extending radially outward from said shaft, and said bias means comprises a coil spring being interposed between said flange and one shoulder and engaging each whereby to bias the one shoulder forwardly relative to the flange and the other shoulder forwardly and against the flange, rotation and axial advance of the shaft during threadable engagement between the male member and the receptacle causing the flange to axially advance against the coil spring and the coil spring to bias the one shoulder and thereby the operating sleeve axially forward.

9. The connector assembly as recited in claim 4 further characterized in that said sleeve includes a continuous annular groove, the drive means includes a shaft having a pair of arcuate sockets, the receptacle comprises a pair of segments each having a rearward end portion including an annular rib extending radially inward into one respective socket for pivotably mounting the segment to the shaft and a forward end portion including an annular rib extending radially outwardly for receipt in the annular groove when the sleeve is in the second position, and a retaining collar is slidably disposed in said operating sleeve and captivated about said shaft, said collar being hollow and circumposing the rearward end portions whereby to captivate each inward annular rib within its respective socket.

10. The connector assembly as recited in claim 9 wherein one and the other said retaining collar and said segments, respectively, include a radial key and an axially extending radially engageable keyway for transmitting external rotational torques transmitted through the drive shaft.

11. The electrical connector assembly as recited in claim 2 wherein said drive means comprises an axial shaft and said bias means comprises a coil spring disposed in encircling relation about the axial shaft.

12. In an electrical connector assembly of the type including a first connector housing, a second connector housing having an externally threaded portion, and releasable retention means for releasably retaining the connector housings mated together, characterized by said releasable retention means being operable to retain the housings together whether the housings have been fully or partially mated and comprising an operating sleeve slidably disposed in said first connector housing for movement between a retaining first position to a releasing second position, an internally threaded segmented receptacle disposed in said sleeve, drive means journalled within said operating sleeve and connected to said segmented receptacle for rotating the receptacle about and threadably engaging the threaded portion, and bias means acting between the drive means and the sleeve for biasing the operating sleeve into the first position, each segment having a rearward end portion pivotally mounted to said drive means and a forward end portion adapted to pivot radially outward relative to said drive means.

* * * * *